United States Patent [19]

Hastings, Jr.

[11] 4,111,283

[45] Sep. 5, 1978

[54] REGULATOR VALVE

[75] Inventor: Russell Hastings, Jr., Battle Creek, Mich.

[73] Assignee: Clark Equipment Company, Buchanan, Mich.

[21] Appl. No.: 752,365

[22] Filed: Dec. 20, 1976

[51] Int. Cl.[2] ..... B66B 9/20; F15B 13/042

[52] U.S. Cl. ..... 187/9 R; 91/29; 91/433; 91/445; 91/447; 137/493

[58] Field of Search ..... 91/29, 445, 447, 468, 91/433; 137/493, 505.22, 505.13, 529; 187/9 E, 9 R

[56] References Cited

U.S. PATENT DOCUMENTS

| | | | |
|---|---|---|---|
| 2,146,537 | 2/1939 | Farnham | 91/468 X |
| 2,495,785 | 1/1950 | Stepaens | 91/29 X |
| 2,603,235 | 7/1952 | Kirkham | 91/447 X |
| 2,701,552 | 2/1955 | Light | 91/445 |
| 2,782,598 | 2/1957 | Gatwood | 91/29 X |
| 3,438,308 | 4/1969 | Nutter | 91/445 |
| 3,456,671 | 7/1969 | Stacey | 91/468 X |
| 3,889,709 | 6/1975 | Dwyer | 137/505.13 X |
| 3,999,462 | 12/1976 | Chamberlain | 91/29 |

FOREIGN PATENT DOCUMENTS

| | | | |
|---|---|---|---|
| 1,817,822 | 1/1972 | Fed. Rep. of Germany | 91/447 |

*Primary Examiner*—Irwin C. Cohen

*Attorney, Agent, or Firm*—John C. Wiessler

[57] ABSTRACT

A two-stage regulator valve, particularly for regulating the operation of single acting hydraulic lift motors in lift trucks, which embodies a spool valve controlling first and second ports in the valve body and responsive at one end to lift motor fluid pressure. At the opposite end the valve is responsive first to the force of a first spring which closes the spool on one port when lift motor fluid is below a predetermined pressure, and secondly, following predetermined compression of the first spring during which both ports are opened to exhaust pressure fluid from the lift motor, to the added combined force of a lift motor pressure responsive piston and a second spring. The piston forms with the spool valve a differential area response to said fluid pressure and together with the second spring regulates the position of the spool valve so as to variably restrict the other port to control the exhaust from the lift motor inversely as a function of the fluid pressure therein. At a predetermined low pressure both ports are fully open, the piston and second spring are fixed in a position inoperative to effect the position of the spool valve, and the first spring is compressed to said predetermined fixed compression. The first spring is effective to close the one port below said predetermined low pressure to prevent exhaust of lift motor fluid, such as in a condition of incipient slack in lifting chains which may be adapted to connect a fork carriage to the lift motor for elevation in an upright.

18 Claims, 2 Drawing Figures

REGULATOR VALVE

BACKGROUND OF THE INVENTION

The field of art to which the invention relates is lifting devices, and more particularly to apparatus for controlling the operation of a lift motor in such a device.

A conventional type of lifting device takes the form of a lift truck including a fork carriage mounted on an extensible upright assembly. The carriage may be raised and lowered by extension and retraction of a hydraulic lift motor which is connected to the carriage by chains reeved within the upright assembly.

Such lift trucks are commonly used in a large variety of applications wherein a load is deposited by an extended upright at a selected elevation above ground level.

It has been common practice heretofore to provide a regulator valve in or associated with the lift motor of such uprights for the purpose of controlling the rate of fluid exhaust from the cylinder of such a motor during lowering or a load as an inverse function of the load on the fork carriage, thus decreasing the lowering speed of the carriage as the load carried thereby is increased. Exemplary valving devices for such a purpose are disclosed in U.S. Pat. Nos. 2,676,573 and 3,016,046.

Both of these patents disclose valve devices in such lift motors for allowing unimpeded pressure fluid flow to the respective lift motor during elevation of a load on the upright, and more or less restricted flow out of the respective lift motor during lowering thereof in order to effect a controlled rate of descent of the load on the upright as a function of the mass of the load carried by the fork carriage. In U.S. Pat. No. 3,016,046 a characteristic inverse relationship between lowering speed and load, which reflects lift motor pressure, is shown in FIG. 3 thereof. Likewise in U.S. Pat. No. 2,676,573 a controlled rate of descent is effected as the lift control valve thereof tends to restrict flow out of the lift motor during lowering of the load as a function of motor pressure, which is desirable. Under a condition of heavy reverse flow surge the latter patent states that the valve device closes off the flow to prevent a sudden drop of the load supported by the upright.

In addition to controlling the rate of descent of such uprights as a function of load, an additional function is desirable, viz., preventing a slack condition of the lifting chains for any reason which might result in a subsequent free drop of the fork and carriage. For example, a slack chain condition can occur if, for any reason, there is an obstruction to lowering of the carriage while an untrained or inattentive operator continues to hold open the directional control valve to attempt to continue to lower the load. Under this condition the weight of the chains, piston head and piston rod continues to exhaust fluid from the lift motor to the reservoir. Then, the sudden release of any obstruction to lowering of the fork carriage and load would permit a free drop thereof until the slack in the chains which connect the lift motor and fork carriage is taken up.

One circumstance which may result in such chain slack is described in the preamble to U.S. Pat. No. 3,438,308. Essentially it is the result of inattention or incompetence of a lift truck operator who continues to exhaust fluid from the lift motor even after the chains begin to go slack when the fork carriage rests on top of a load, such as inside of a pallet and load just deposited at an elevated position. When the truck is then backed off, the fork carriage drops abruptly on moving away from the previously supporting surface and the sudden take up in chain slack may produce needless wear or fatigue in the chains and associated parts.

U.S. Pat. No. 3,438,308 discloses a valve device which is constructed to admit a flow of pressure fluid to a lift motor during elevation of a lift truck upright, to exhaust pressure fluid from the lift motor during normal operation thereof, and to prevent the continued exhaust of fluid from the lift motor upon a predetermined decrease in the fluid pressure therein for preventing a slack chain condition.

SUMMARY

A load lifting device having a hydraulic lift motor and load carriage with flexible means connecting the carriage to the lift motor for elevation, wherein a hydraulic control system includes a two-stage hydraulic regulator valve connected to the lift motor for regulating fluid exhaust therefrom during lowering thereof inversely as a function of lift motor fluid pressure, and wherein the valve is responsive at one side to lift motor pressure and at the opposite side successively to the forces of first and second springs during movement of the valve in one direction to regulate the exhaust of fluid from the lift motor inversely as a function of lift motor fluid pressure, movement in the opposite direction to a closed position being effected by the first spring when the lift motor pressure decreases to a predetermined low pressure, thereby preventing fluid exhaust from the lift motor and preventing slack in the flexible means.

DESCRIPTION OF THE PREFERRED EMBODIMENT

Figure 1:
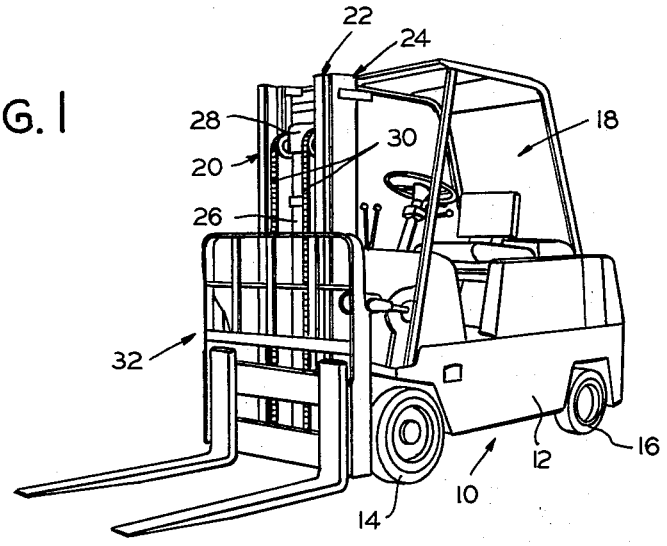
FIG. 1 is a perspective view of a fork lift truck.

An industrial lift truck is shown generally at numeral 10. It comprises a body and frame structure 12 supported from drive and steer wheels and axles 14 and 16, respectively, an operator station 18, and an upright assembly 20 mounted from the drive axle. The upright assembly is of well known type having an inner telescoping I-beam section 22 mounted for elevation in an outer channel section 24, a hydraulic lift cylinder motor 26 in the upright having a cross head 28 at the piston rod end thereof which carry a pair of sprockets on which are reeved a pair of chains 30 connected at one end to a fork and carriage assembly 32, which is supported from and mounted for elevation in upright section 22 by the lift motor, and fixed at the other end in relation to the movable parts of the upright assembly.

Figure 2:
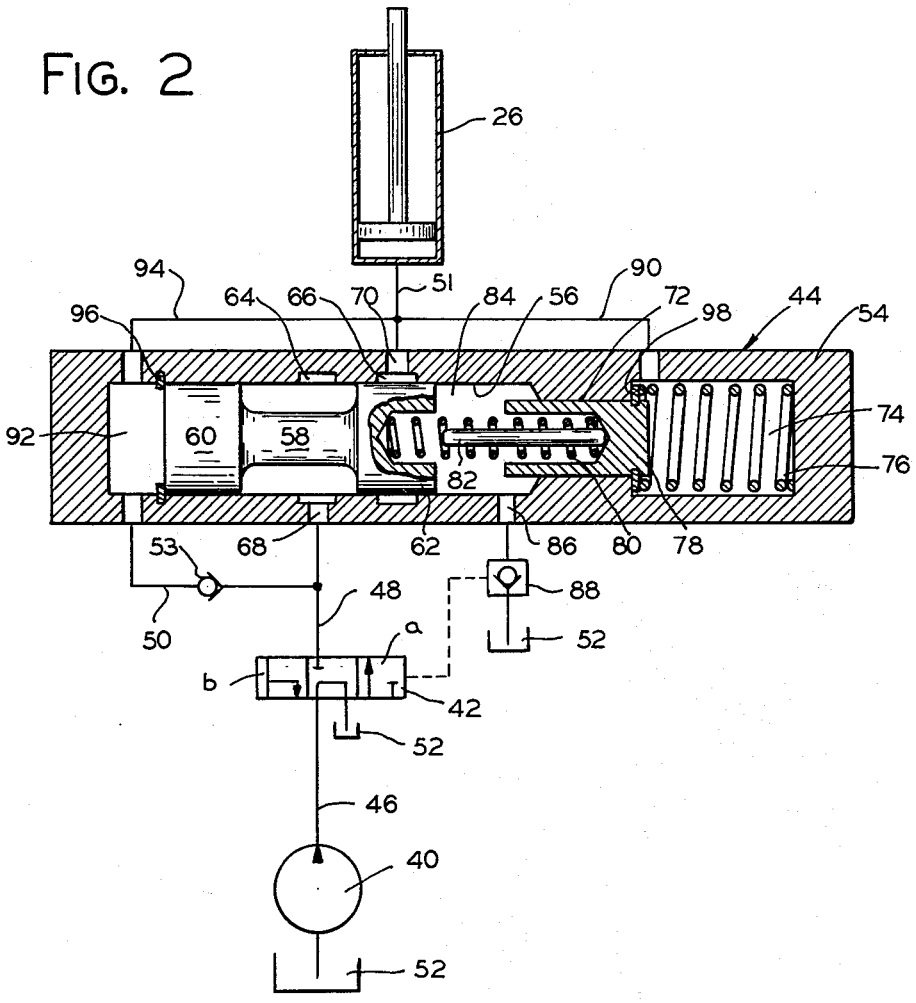
FIG. 2 is a schematic diagram of a hydraulic system which includes the hydraulic lift motor of the lift truck and in which my valve device is shown in longitudinal section.

Referring to FIG. 2, a supply pump 40 is connected to an open-center two-way directional control valve 42 and to the valve device of my invention shown generally at 44 by way of conduits 46, 48 and 50, and to lift motor 26 by a line 51. A check valve 53 is located in line 50. Valve 42 is actuated to register section *a* thereof with lines 46 and 48 for elevating lift motor 26, and thereby the upright and fork carriage assembly, and is actuated to register section *b* to connect both the lift motor and pump to the reservoir to lower the lift motor and upright assembly.

Valve device 44 comprises a housing 54 having a longitudinal bore 56 in which is located a spool valve element 58 having lands 60 and 62 adapted to cooperate with a pair of axially spaced annular ports 64 and 66 which are connected by passages 68 and 70 to lines 48 and 51, respectively. A smaller axial bore 72 connects bore 56 with a chamber 74 which, as shown, houses a relatively heavy spring 76. A cup-shaped piston 78 is mounted slidably in bore 72 and extends into both bore 56 and chamber 74. A relatively light spring 80 extends axially of the bores and abuts at its opposite ends the bottoms of the recessed portions of piston 78 and spool 62, as shown. A floating stop pin and spring retainer element 82 extends inside of spring 80, chamber 84 between the spool and the piston element being vented to reservoir 52 by a passage 86 and check valve 88, the check valve being pilot operated and connected in known manner to be opened when valve 42 is actuated to lower the lift motor to vent chamber 84 to reservoir so that no fluid pressure builds up in the chamber. Lift motor 26 is single acting, the pressure chamber of which is connected from line 51 also to chamber 74 by a line 90 and to a chamber 92 by a line 94. A stop 96 is located in chamber 92 to limit the leftward movement of the spool, and a split ring 98 is located on piston element 78 in chamber 74. Ring 98 abuts the one end of spring 76, the force of which is thereby applied to piston 78; ring 98 also limits the leftward movement of the piston as shown.

In operation, operator's control valve 42 may be manipulated to elevate, lower, or maintain a selected elevation of lift motor 26, and therefore of the upright assembly. Located as shown in an open-center position, pump 40 operates continuously when the truck power plant is in operation, the pump discharge being vented to the reservoir.

When the hydraulic pressure in the lift motor is equal to a predetermined minimum, such as 10 psi, which will be referred to herein to represent an exemplary predetermined minimum control pressure, that same control pressure first acts on the left end of spool 60 in chamber 92 to actuate valve element 58 rightwardly against light spring 80 until it first contacts stop pin 82. At the latter location the right hand surface of land 60 is located substantially coincident with the left hand edge of port 64, and the left hand surface of land 62 is located substantially coincident with the right hand edge of port 66, piston 78 remaining in its illustrated position, thus providing unrestricted flow through valve section 42 *a* to the lift motor by the parallel routes of valve ports 64, 66 and the connecting conduits from valve 42 to the lift motor, and by way of check valve 53, chamber 92 and the parallel connecting conduits between valve 42 and the lift motor. Therefore, it will be apparent that the spring rate of light spring 80 is such as to control or restrict the effective area of port 66 at pressures below 10 psi and to be ineffective to control the area of port 64 at pressures above 10 psi. At lift motor pressures above the assumed 10 psi control pressure the higher pressures act on the differential area between land 60 and piston 78 to compress spring 76 and restrict port 64 as a function of the resultant force acting against the rate of heavy spring 76. However, the by-pass circuit through chamber 92 is designed to supply a sufficient volume of fluid to the lift motor under all loads for which the lift truck is designed that no effective restriction to flow occurs during lifting operations irrespective of the restrictive position of land 60 in relation to port 64. Therefore all loads handled by the lift truck to capacity load may be elevated at maximum lifting speed.

It should be pointed out that the use of an axially located stop pin 82 is desirable, but not essential, inasmuch as the interior length of the piston 78 could readily be extended to perform the limit stop function of pin 82 in abutment with the right hand surface of land 62. However, the central stop pin 82 is preferred to insure that the reaction forces between the valve element and piston are always properly centered. Otherwise, any lack of squareness between these elements would cause a misaligning force adding friction, and thus causing the valve to be less sensitive to small changes in pressure, which, as will be seen below, is important to the operation of my invention, i.e., that the value 58 be responsive to small pressure changes below 10 psi during lowering of the lift motor.

If the operator actuates valve 42 from its open center position to valve section *b* with the lift motor fixed at any given elevation the weight of any load on the fork, plus the weight of the carriage assembly 32, chains 30, the piston, piston rod and at times the inner upright section 22 combine to exhaust pressure fluid from the lift motor to the reservoir by way of ports 66, 64 and valve section 42 *b* through the connecting conduits. Check valve 53 prohibits backflow through the circuit of chamber 92, and check valve 88 prohibits backflow to reservoir of any leakage fluid from the lift motor past land 62 into chamber 84 and through passage 86 to reservoir 52 while the carriage is being held at any height.

Under all loads, including no load on the fork under normal operating conditions, the pressure produced in chamber 92 is 10 psi or more to effect a movement of valve element 58 as aforesaid into abutment with pin 82 and, under the load only of an empty fork, permits full speed lowering with no restriction at ports 66 and 64, the same as during elevation. More or less load on the fork during lowering produces more or less pressure in chambers 92 and 74 which act on the differential area of the spool and piston as aforesaid to compress spring 76. Since spring 76 acts only against the differential force, increasing loads on the fork effects a regulation of the degree of restriction at port 64 as a function of the load, land 60 restricting port 64 increasingly with greater loads. Inherent in my design is a pre-setting during raising or holding a load at any elevation so that land 60 is always located at the correct control position for the desired lowering speed when subsequently the load is lowered.

As will be understood, the normal weight of the mechanism with the fork under no load is sufficient to produce the exemplary 10 psi in the system so that the fork may be lowered at maximum speed. Under any condition wherein the system pressure falls below 10 psi the force on spool 58 is insufficient to hold it against pin 82, whereupon light spring 80 controls the spool as it moves left with pressure decrease below 10 psi until it abuts stop 96. As land 62 moves leftwardly it shuts off all flow from the lift motor and stops immediately lowering of the fork carriage and upright assembly at some point in travel prior to engagement with stop 96, as is apparent. This abrupt interruption of downward fork movement occurs at, assume, 8 psi in the present example depending upon the rate of spring 80. Valve assembly 44 is designed not to block the descent of an empty carriage and forks, for example, merely because of incidental changes in friction caused by unequal tension of the chains or by other incidental obstructions, which may occur when lowering an off-center load, for example, because the eccentric loading on the fork will add significantly to the friction between the guide rollers and upright sections, as is well known.

However, in the event of an incipient drop in pressure below 10 psi, such as at 8 psi, which signals the beginning of or forewarns a slack chain condition at which only the weight of the chains, piston and piston rod is applied to exhaust hydraulic fluid from the lift motor, spring 80 has already actuated land 62 to cover port 66 thereby terminating immediately further lowering of the fork, irrespective of whether an operator continues to hold open valve 42 in position 42 *b*. Of course, as soon as the pressure rises again to 10 psi or more after an incipient slack chain condition is alleviated, as by elevating the fork from an obstruction, the valve spool 58 and piston 78 move to positions determined by the hydraulic pressure, so that the valve is ready to regulate the speed of subsequent lowering as aforesaid.

Thus, my valve device provides a highly sensitive response to changes in pressure below a predetermined low pressure in order to avoid the advent of a slack chain condition for any reason, while, at the same time the valve is designed to provide a combination of other desirable functions, viz., high speed unrestricted lift, and lowering speed regulating as an inverse function of load on the fork.

It will be apparent to those skilled in the art that various changes in the structure and relative arrangement of parts may be made without necessarily departing from the scope of my invention. It will also be apparent, that, although the primary emphasis herein has been directed to an application for a lift truck upright, that many other applications may be found for my novel two-stage flow regulating valve, and it is not my intention to be limited to any particular form or application of the invention as illustrated and described in respect of the single embodiment hereof, except as may be limited in the claims appended.

I claim:

1. In combination with a load lifting upright having a load supporting carriage mounted for vertical movement on the upright, an extensible hydraulic lift motor, flexible means operated by the lift motor and secured at one end to the carriage for raising and lowering the carriage in the upright during extension and retraction of the lift motor, a fluid pressure supply, a reservoir, conduit means connecting said pressure supply to the lift motor and to the reservoir and a control in the conduit means adjustable to effect raising and lowering of said lift motor and carriage, regulator means in the conduit means for preventing a slack condition of the flexible means comprising a valve regulating the fluid flow exhausted from the lift motor during lowering thereof, said valve being responsive at one side thereof to the fluid pressure in the lift motor and at the opposite side thereof simultaneously to the forces of a first spring means and of the combined force of a second spring means and a lift motor fluid pressure responsive means during movement of the valve to regulate the fluid flow exhausted from the lift motor, the force of said second spring means being effective on said valve subsequent to the force of said first spring means, said fluid flow exhaust being regulated by said valve inversely as a function of fluid pressure in the lift motor, movement of the valve to a closed position being effected by said first spring means when the fluid pressure in the lift motor decreases to a predetermined low pressure whereby to prevent fluid exhaust from the lift motor.

2. A combination as claimed in claim 1 wherein said valve is a spool valve and said fluid pressure responsive means is a piston.

3. A combination as claimd in claim 1 wherein said fluid pressure responsive means is responsive to the fluid pressure in said lift motor for providing together with said valve a differential area response to the lift motor fluid pressure.

4. A combination as claimed in claim 3 wherein said differential area response occurs subsequent to predetermined compression of said first spring means.

5. A combination as claimed in claim 2 wherein said responsive one side of said spool valve provides a relatively large area and said piston provides a smaller area responsive both to the fluid pressure in said lift motor and to said second spring means.

6. A combination as claimed in claim 5 wherein said first spring means is interposed between said spool valve and piston such that said piston and second spring means are inoperative to oppose movement of said spool valve prior to predetermined compression of said first spring means.

7. A combination as claimed in claim 6 wherein movable stop means extends axially of said first spring means for stopping movement of said spool valve relative to said piston at said predetermined compression of said first spring means.

8. A combination as claimed in claim 6 wherein closing movement of said spool valve to prevent fluid exhaust from said lift motor is effected by said first spring means while said piston and second spring means are rendered inoperative.

9. A combination as claimed in claim 1 wherein said conduit means includes a by-pass conduit connecting said lift motor and said one side of said regulating valve constructed so that fluid may flow in one direction only to said lift motor.

10. A combination as claimed in claim 1 wherein porting means in said regulating valve are not restricted by said valve at full predetermined compression of said first spring means and prior to compression of said second spring means.

11. A combination as claimed in claim 10 wherein during compression of said second spring means said porting means is restricted, and piston means interposed between said first and second spring means responsive to fluid pressure in the lift motor opposing with said second spring means movement of said regulating valve to restrict said porting means.

12. A combination as claimed in claim 1 wherein said valve closes at a predetermined low lift motor pressure during an incipient slack condition of said flexible means.

13. A combination as claimed in claim 1 wherein said first spring means is a relatively light spring and said second spring means is a relatively heavy spring.

14. In combination with a single acting lift motor, a two-stage flow control valve for regulating the exhaust of fluid from the lift motor comprising a valve body, first and second spaced ports in said body connecting the control valve to the lift motor and to a reservoir, and a spool valve in said body having first and second lands controlling said first and second ports, respectively, and responsive at one side to lift motor fluid pressure, said spool valve being responsive at the opposite side successively to the forces of first and second spring means to regulate the lift motor exhaust flow at said first port by said first land inversely as a function of lift motor fluid pressure, said first spring means being adapted to close said second port by means of said second land to prevent exhaust from the lift motor below a predetermined low pressure at which said second spring means is rendered inoperative to affect the position of the spool valve.

15. A flow control valve as claimed in claim 14 wherein a lift motor pressure responsive piston functions together with said second spring means at said opposite side of the spool valve to provide together with said one side of the spool valve a differential area response to lift motor fluid pressure during control of said first port by said first land.

16. A flow control valve as claimed in claim 15 wherein said first spring means is interposed between said piston and said spool valve, and stop means renders inoperative said piston and second spring means when said first spring means actuates said spool valve to close said second port means.

17. A flow control valve as claimed in claim 14 wherein movement of said spool valve to open said second port occurs during compression of said first spring means to a predetermined fixed compression thereof, and continued movement of said spool valve to regulate said first port occurs during subsequent compression of said second spring means as fluid pressure in the lift motor increases.

18. In a load lifting device having an extensible hydraulic lift motor and load carriage with flexible means connecting the carriage to the lift motor for raising and lowering the carriage, a two-stage hydraulic regulator valve connected to the lift motor for regulating fluid exhaust therefrom during lowering of the carriage, the valve being responsive at one side to lift motor fluid pressure and at the opposite side simultaneously to the forces of a first spring and of the combined force of a second spring and a lift motor fluid pressure responsive means during movement of the valve in one direction to decrease the rate of exhaust of fluid from the lift motor as lift motor fluid pressure increases, movement of said valve to a closed position being effected in an opposite direction by the first spring when the lift motor fluid pressure decreases below a predetermined low pressure, thereby preventing fluid exhaust from the lift motor and preventing slack in the flexible means.

* * * * *